US009079293B2

(12) United States Patent
Roth et al.

(10) Patent No.: US 9,079,293 B2
(45) Date of Patent: Jul. 14, 2015

(54) MOBILE COLLECTING DEVICE FOR THE HIGH-PRESSURE WATER JET OF A WATER-JET TOOL AND METHOD OF USE

(75) Inventors: Philipp Roth, Baden (CH); Josef Erni, Winterthur (CH); Walter Maurer, Oftringen (CH)

(73) Assignee: ALSTOM Technology Ltd, Baden (CH)

( * ) Notice: Subject to any disclaimer, the term of this patent is extended or adjusted under 35 U.S.C. 154(b) by 864 days.

(21) Appl. No.: 12/349,121

(22) Filed: Jan. 6, 2009

(65) Prior Publication Data

US 2009/0178526 A1 Jul. 16, 2009

(30) Foreign Application Priority Data

Jan. 10, 2008 (CH) ..... 0036/08

(51) Int. Cl.
*B24C 9/00* (2006.01)
*B26F 3/00* (2006.01)

(52) U.S. Cl.
CPC . *B24C 9/00* (2013.01); *B26F 3/008* (2013.01); *B26F 3/004* (2013.01)

(58) Field of Classification Search
USPC ..... 83/177, 941; 451/75, 87, 99, 453; 138/40–46
See application file for complete search history.

(56) References Cited

U.S. PATENT DOCUMENTS

| | | | | | |
|---|---|---|---|---|---|
| 2,559,069 | A | * | 7/1951 | England | 138/42 |
| 4,112,797 | A | | 9/1978 | Pearl | |
| 4,501,182 | A | * | 2/1985 | Jardat et al. | 83/177 |
| 4,669,229 | A | * | 6/1987 | Ehlbeck | 451/39 |
| 4,872,293 | A | | 10/1989 | Yasukawa et al. | |
| 4,920,841 | A | | 5/1990 | Johnson | |
| 5,158,272 | A | * | 10/1992 | Biervert et al. | 269/21 |
| 5,295,425 | A | | 3/1994 | Hediger | |
| 5,980,372 | A | * | 11/1999 | Spishak | 451/453 |
| 2007/0207702 | A1 | | 9/2007 | Trieb et al. | |

FOREIGN PATENT DOCUMENTS

| | | | |
|---|---|---|---|
| DE | 19529589 | | 10/1996 |
| DE | 19618523 | | 11/1997 |
| EP | 0244966 | | 11/1987 |
| EP | 0252657 | | 1/1988 |
| EP | 1172189 | | 1/2002 |
| JP | 01153299 A | * | 6/1989 |
| JP | 02243297 | * | 9/1990 |
| WO | WO00/18552 | | 4/2000 |

OTHER PUBLICATIONS

Yamada, B., et al., "On the Development and Application of a Method of Remodeling Utilising an Abrasive Jet System," 9th International Symposium on Jet Cutting Technology, Sendai, Japan, Oct. 4-6, 1988, Paper E1, pp. 203-215, BHRA, Bedford, United Kingdom.
Search Report from Swiss Patent App. No. 0036/2008 (May 1, 2008).
Search Report from European Patent App. No. 09150042.1 (Apr. 23, 2009).

* cited by examiner

*Primary Examiner* — Stephen Choi

(57) ABSTRACT

A mobile collecting device (22) for the high-pressure water jet (26) of a water-jet tool (18), especially for working in confined places with difficult access in turbines or the like, in which a more flexible and safer operation is achieved by a closed collecting chamber (24), which extends over a large area and includes an outlet (30), and in which a rigid first collecting bed (34) formed of a first high-pressure-resistant material is arranged.

6 Claims, 2 Drawing Sheets

MOBILE COLLECTING DEVICE FOR THE HIGH-PRESSURE WATER JET OF A WATER-JET TOOL AND METHOD OF USE

This application claims priority under 35 U.S.C. §119 to Swiss application no. 00036/08, filed 10 Jan. 2008, the entirety of which is incorporated by reference herein.

BACKGROUND

1. Field of Endeavor

The present invention refers to the field of machining of workpieces by material stripping. It relates to a mobile collecting device for the high-pressure water jet of a water jet tool and also to a method for its operation.

2. Brief Description of the Related Art

It has been known for a long time to use a water jet, which issues under very high pressure from a nozzle, for the machining, especially the cutting, of workpieces. In the case of so-called "abrasive water-jet cutting" (AWJ), water pressures of more than 300 MPa are used in order to produce a water jet, which is laden with abrasive substances, with a jet diameter of typically 1 mm. Such a water jet can be used as a cutting tool which acts in all directions and with which a wide range of metallic and non-metallic materials, with thicknesses of up to 200 mm, can be cut through. In this case, it is important not to only collect and drain off the water of the high-pressure water jet, but especially to render the kinetic energy of the water jet harmless by conversion into thermal energy if this water jet has worked its way through the workpiece and discharged rearwards (downwards) from the workpiece.

In the case of stationary systems, in which the nozzle head of the water-jet tool is movable in a plane in X and Y directions, the mostly plate-form workpiece is fixed on a largely jet-penetrable support base. Beneath the support base, special devices are then arranged over a large area for collecting and rendering harmless the high-pressure water jet which passes through the workpiece (see for example U.S. Pat. Nos. 4,112,797 and 5,295,425).

Compact collecting devices have already been proposed, however, which can be moved together with the water-jet tool and can also be used in the case of confined space conditions at the application site (see for example EP-A2-0 244 966 and EP-A2-0 252 657). In this case, however, it is disadvantageous that the entry areas which are provided for the water jet are very small so that the collecting devices have to be adjusted very accurately to the water-jet tool.

In a prior application of the assignee of this application, it was proposed to use a water-jet tool with turbine rotors and other components of power plants. With the turbine rotors fitted with rotor blades, according to FIGS. 1 and 2, it is a matter of separating the blades 12, which are detachably fastened on the turbine wheels 11 of the rotor 10, from the rotor 10 by cutting up the bolts 17, which are interference-fitted in corresponding holes 16 and connect the blade roots 14, which are beneath the blade platform 13 and recessed in annular grooves 15, to the turbine wheel 11, by a water-jet tool 18 in the longitudinal direction, and then forcing out the bolt sections from the holes 16. The water-jet tool 18, which includes a tool body 19 and an angled nozzle head 20 and is supplied with water via a water feed line 21, is introduced into the interspace between adjacent turbine wheels 11 and 11' (FIG. 2) for this purpose. If the bolt 17 is cut through in the longitudinal direction, the high-pressure water jet discharges on the other side of the turbine disk 11 into the interspace which exists there and can cause damage if it is not collected and rendered harmless.

SUMMARY

One of numerous aspects of the present invention includes a collecting device for the high-pressure water jet of a water-jet tool which, even in inaccessible places and in the case of confined space conditions, can be used in different spatial positions in order to safely collect the water jet which passes through the workpiece during workpiece machining, and also a method for its operation.

According to another aspect, a closed collecting chamber, which extends over a large area and is provided with an outlet, and in which a rigid first collecting bed having a first high-pressure-resistant material is arranged, is advantageously provided for the device.

One exemplary development includes that the first collecting bed includes a plurality of layers, having the first high-pressure-resistant material, which are arranged one above the other, each of the layers is constructed from bars, formed of the first high-pressure-resistant material, which lie parallel in one plane next to each other, and the bars of consecutive layers are oriented orthogonally to each other.

Another exemplary development includes that a hard material is used as the first high-pressure-resistant material, wherein tungsten carbide (WC) is preferably used as the hard material.

A further exemplary development includes that the first collecting bed fills out the lower part of the collecting chamber, the upper part of the collecting chamber is filled with a filling material, and waste or fragmented material of the first high-pressure-resistant material is used as the filling material.

Another exemplary development includes that the collecting chamber is accommodated in a cubic housing and on the upper side which faces the high-pressure water jet is closed off by a cover of the housing.

According to a preferred exemplary development, a safety chamber is arranged after the collecting chamber in the direction of the high-pressure water jet, wherein in the safety chamber, a rigid second collecting bed formed of a second high-pressure-resistant material is arranged, the second collecting bed includes a plurality of layers, formed of the second high-pressure-resistant material, which are arranged one above the other, each of the layers is constructed from bars, formed of the second high-pressure-resistant material, which lie parallel in one plane next to each other, the bars of consecutive layers are oriented orthogonally to each other, and wherein the second high-pressure-resistant material is identical to the first high-pressure-resistant material.

Another exemplary development includes that the collecting chamber and the safety chamber are separated from each other by a partition, the safety chamber has openings, and a moisture sensor is associated with the openings and detects water which discharges from the opening of the safety chamber.

Furthermore, it is advantageous if an acceleration sensor is arranged on the collecting device for detecting penetration of the high-pressure water jet through a workpiece which is to be machined and located upstream of the collecting device.

In particular, the sensors are connected to a signal processing device which, at a signal output, generates a signal for controlling the water-jet tool.

Exemplary methods according to principles of the present invention include that the first impact of the high-pressure water jet upon the collecting device is detected in each case, and a corresponding signal is used for controlling the use of the water-jet tool, or a malfunction of the collecting device is detected and a corresponding signal is used for terminating the use of the water-jet tool.

BRIEF DESCRIPTION OF THE DRAWINGS

The invention is to be explained in more detail in the following based on exemplary embodiments in conjunction with the drawing. In the drawing

DETAILED DESCRIPTION OF EXEMPLARY EMBODIMENTS

Figure 1:
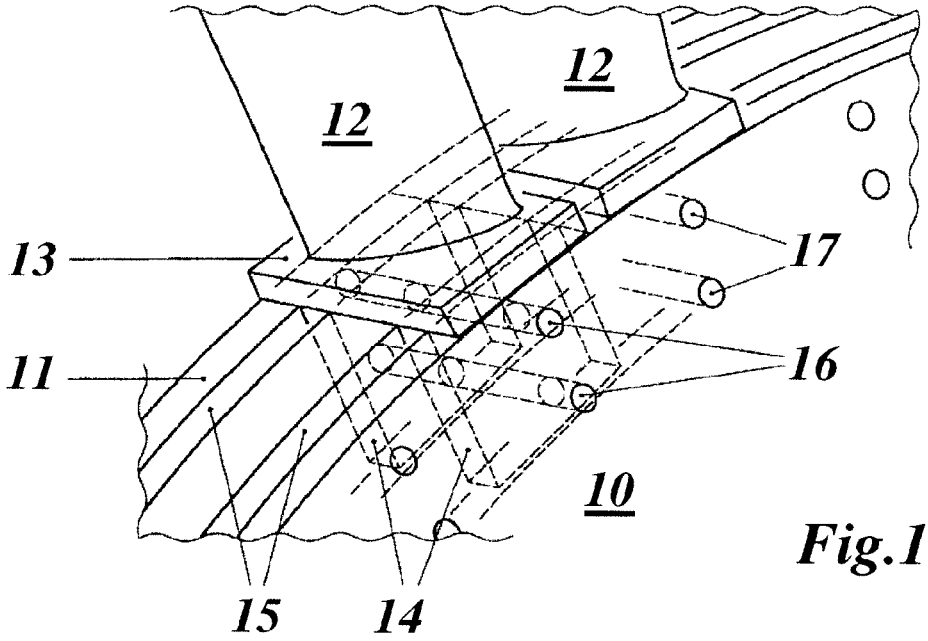
FIG. 1 shows in a perspective view a detail of a rotor with blades which are fastened on the rotor by means of bolts.
Figure 2:
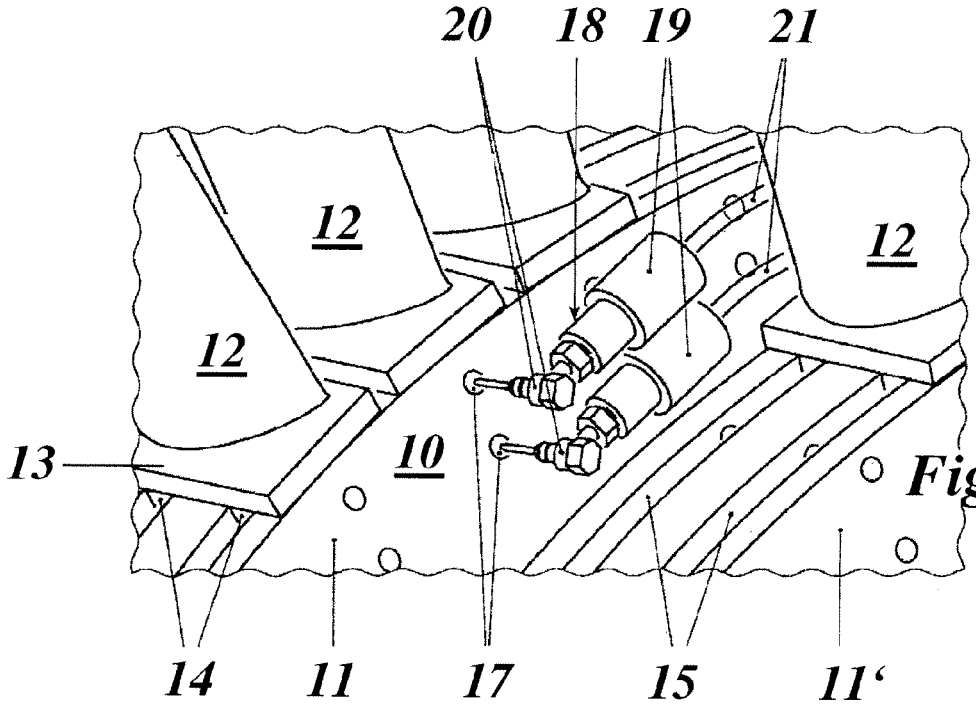
FIG. 2 shows, in a view which is comparable to FIG. 1, a method for removing the fastening bolts of the rotor blades by a high-pressure water jet.
Figure 3:
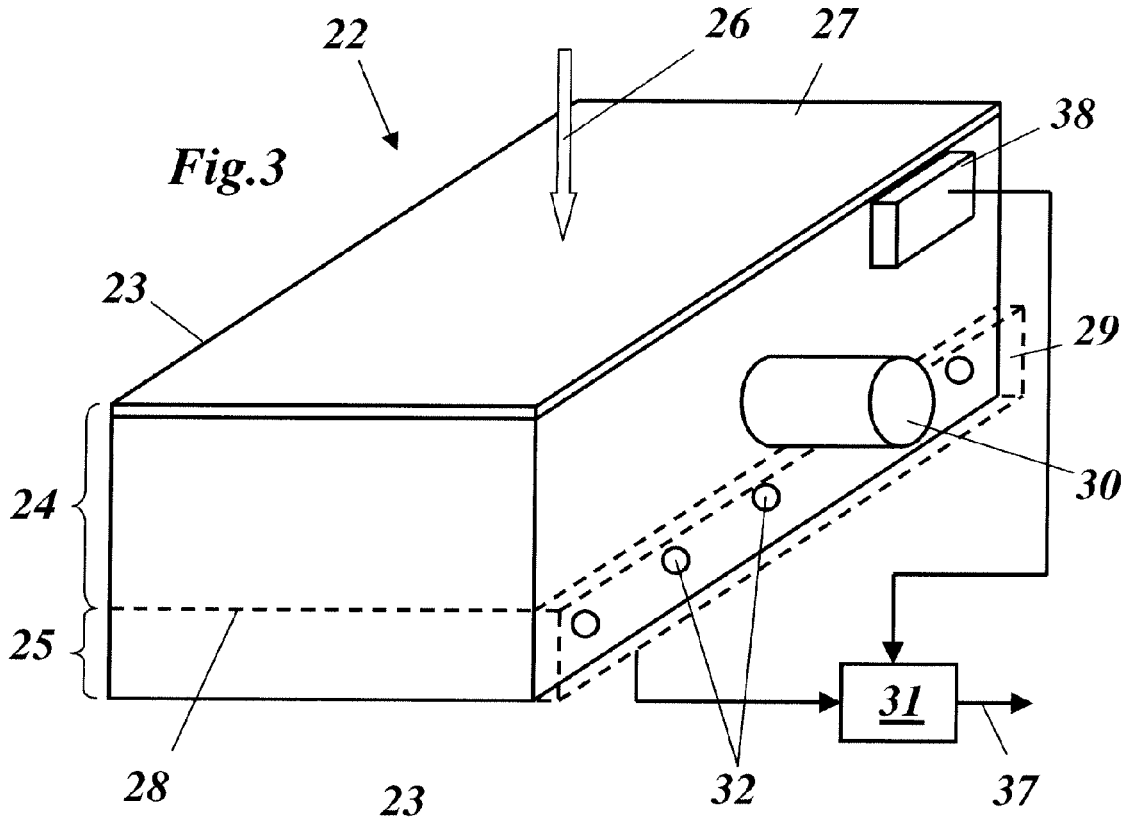
FIG. 3 shows a mobile collecting device for a high-pressure water jet according to FIG. 2 according to an exemplary embodiment of the invention.

In FIG. 3, a mobile collecting device for a high-pressure water jet according to an exemplary embodiment of the invention is reproduced. This collecting device 22 is particularly suitable for applications when machining turbine rotors (FIG. 2) and components of power plants, in which the space which is made available is limited. The external dimensions of the exemplary collecting device 22 are approximately 200 mm×80 mm×80 mm so that it can be used in the narrow interspaces between adjacent turbine wheels (11, 11' in FIG. 2) or rotor disks.

Figure 4:
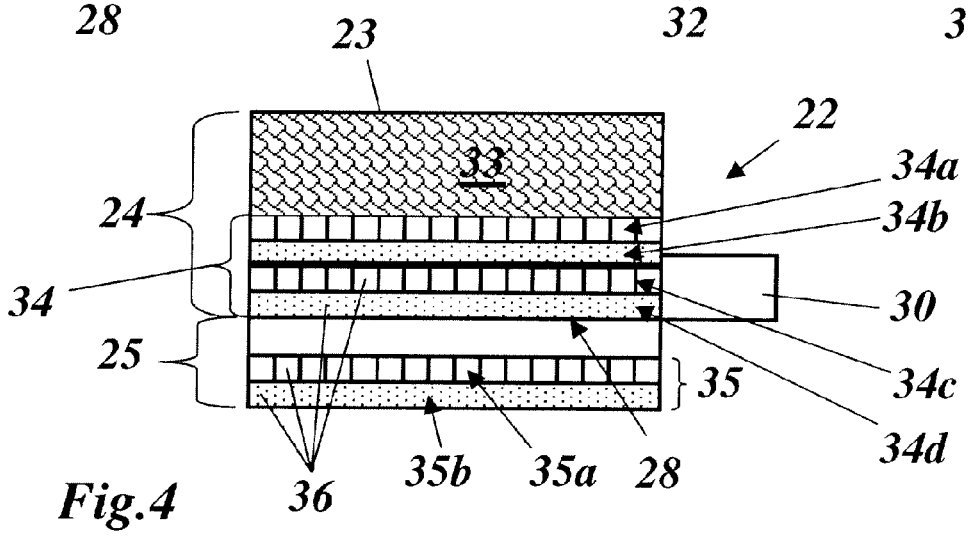
FIG. 4 shows the internal construction of the collecting device from FIG. 3.

The collecting device 22 of FIG. 3 has a cubic housing 23 which is closed off at the top by a cover 27. The interior space of the housing 23 or of the collecting device 22 is divided by a partition 28, which lies parallel to the cover 27, into two chambers, specifically the (upper) collecting chamber 24, in which the residual kinetic energy of the abrasive high-pressure water jet 26 is absorbed and converted into thermal energy, and the (lower) safety chamber 25, by which it can be established when the device fails in its normal service so that the machining process can be aborted in sufficient time. The internal structure of the collecting device 22 is reproduced in FIG. 4 in side view.

The collecting chamber 24 is filled at the bottom, i.e., directly above the partition 28, with a first collecting bed 34 formed of at least four layers 34*a-d* of bars 36, advantageously made of tungsten carbide (WC), which lie one above the other. The bars 36 of the same layer in this case are oriented parallel to each other, but perpendicularly to the bars of the adjacent layers so that a crosswise alternating lamination results. Above the layers 34*a-d*, the collecting chamber 24 is filled with loose filling material 33 which includes or consists of WC waste or fragmented material (for example, used WC reversible tips). The filling material 33 serves for breaking down the coherence of the high-pressure water jet which enters the chamber. At the bottom of the collecting chamber 24, an outlet 30 is attached, by which the material (water and solid particles) which enters the collecting chamber can be sucked out by a suction device in order to keep the application area clean.

The safety chamber 25, which lies beneath the partition 28, at the bottom is filled with a second collecting bed 35 formed of at least two layers 35*a, b* of bars 36 made of tungsten carbide, which are again arranged in a crosswise manner. A plurality of openings of small diameter, which serve as outlets and to which a moisture sensor 29 (drawn in with a dashed line in FIG. 3) is allocated, are provided on one side of the safety chamber 25. The moisture sensor 29 is activated if the high-pressure water jet 26 breaks through the collecting chamber 24 into the safety chamber 25 which lies beneath it so that the machining process can be stopped in sufficient time. The two layers 35*a, b* contain the jet in the process until the moisture sensor 29 has been safely activated.

An acceleration sensor 38 can be advantageously attached on the outer side of the collecting device 22 and is activated if the high-pressure water jet 26 passes for the first time through the workpiece, which is to be machined, onto the collecting device 22.

Both the acceleration sensor 38 and the moisture sensor 29 can be used for controlling or checking the machining process. For this purpose, the sensors are connected to a signal processing device 31 which at a signal output 37 delivers corresponding control signals to the control unit (not shown in the figures) of the machining processes. The collecting device thus becomes part of the control system of the water-jet tool. If the moisture sensor 29 is activated, the machining process is aborted. If the acceleration sensor 28 is activated, for example the next machining step is initiated.

The collecting device 22 is simply and inexpensively constructed and represents an easily exchangeable wear-resistant component. It can be installed in an exchangeable manner in an application-specific holder.

LIST OF DESIGNATIONS

10 Rotor (turbine)
11, 11' Turbine wheel
12 Blade
13 Blade platform
14 Blade root
15 Annular groove (turbine wheel)
16 Hole
17 Bolt
18 Water-jet tool
19 Tool body
20 Nozzle head
21 Water feed line
22 Collecting device
23 Housing
24 Collecting chamber
25 Safety chamber
26 High-pressure water jet
27 Cover
28 Partition
29 Moisture sensor
30 Outlet (collecting chamber)
31 Signal processing device
32 Opening (safety chamber)
33 Filling material (for example WC waste)
34 Collecting bed
34*a-d* Layer (for example WC bars)
35 Collecting bed
35*a, b* Layer (for example WC bars)
36 Bar
37 Signal output
38 Acceleration sensor While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A mobile collecting device for a high-pressure water jet of a water-jet tool, the device comprising:

a closed collecting chamber extending over an area including an outlet and a cover;

a partition disposed within the closed collecting chamber parallel to the cover defining upper and lower collecting chambers, with the upper collecting chamber comprising a fixed first collecting bed directly above the partition comprising a plurality of layers, each layer formed of a hard substance as a first high-pressure-resistant material, arranged one above the other with each of the plurality of layers comprising bars formed of the first high-pressure-resistant material, the bars extending parallel in one plane next to each other with bars of consecutive layers oriented orthogonally to each other, the outlet attached at a bottom of the upper collecting chamber to enable exit of material therefrom, and the lower collecting chamber comprising a second collecting bed below the partition comprising at least one layer with openings and a moisture sensor associated with the openings operable to detect moisture discharged from the upper collecting chamber; and an acceleration sensor suitable for detecting penetration of the high-pressure water jet through a workpiece arranged on the collecting device.

2. The collecting device as claimed in claim 1, wherein the hard substance is tungsten carbide.

3. The collecting device as claimed in claim 1, further comprising:

a cubic housing having an upper side and the cover at said upper side, with the collecting chamber positioned in the cubic housing, and the upper side being closed off by the cover.

4. The collecting device as claimed in claim 1, wherein the bars in consecutive layers are in contact with each other.

5. The collecting device as claimed in claim 1, where the closed collecting chamber is filled at the bottom with the plurality of layers.

6. The collecting device as claimed in claim 1, where the acceleration sensor is connected to a signal processing device which, at a signal output, generates a signal for controlling the water-jet tool.

* * * * *